US005189842A

United States Patent [19]

Kobayashi et al.

[11] Patent Number: 5,189,842

[45] Date of Patent: Mar. 2, 1993

[54] BARREL FINISHING MACHINE

[75] Inventors: Hisamine Kobayashi; Katsuhiro Izuhara, both of Nagoya, Japan

[73] Assignee: Tipton Manufacturing Corporation, Nagoya, Japan

[21] Appl. No.: 682,108

[22] Filed: Apr. 8, 1991

[30] Foreign Application Priority Data

Apr. 6, 1990 [JP] Japan ..... 2-37628

[51] Int. Cl.[5] ..... B24B 31/00

[52] U.S. Cl. ..... 51/163.1; 51/164.1

[58] Field of Search ..... 51/163.1, 163.2, 164.1, 51/164.2

[56] References Cited

U.S. PATENT DOCUMENTS

| | | | |
|---|---|---|---|
| 4,850,151 | 7/1989 | Ditscherlein | 51/163.2 |
| 4,884,372 | 12/1989 | McNeil | 51/163.1 |
| 4,958,776 | 9/1990 | Walther | 51/163.2 |
| 5,012,620 | 5/1991 | McNeil | 51/163.2 |

FOREIGN PATENT DOCUMENTS

| | | | |
|---|---|---|---|
| 184667 | 11/1982 | Japan | 51/164.1 |

*Primary Examiner*—M. Rachuba

*Attorney, Agent, or Firm*—Wenderoth, Lind & Ponack

[57] ABSTRACT

A barrel finishing machine includes a dual barrel structure including a cylindrical stationary container and a rotary container concentrically mounted in the stationary container for rotation, with a small gap between them. Linings are formed from an elastic material and are provided to cover inner surfaces of the stationary and rotary containers respectively, and a stopper is mounted in the lining of the rotary container at a position in the vicinity of an outer circumferential edge of the rotary container. The stopper is effective to restrain expansive deformation of the lining of the rotary container due to thermal expansion. The stopper circumferentially rises from a base of the rotary container. The stopper member is detachably attached relative to the base of the rotary container.

8 Claims, 4 Drawing Sheets

BARREL FINISHING MACHINE

BACKGROUND OF THE INVENTION

This invention relates generally to a workpiece surface finishing machine, and more particularly to an improved barrel finishing machine having a dual barrel structure with linings and stopper means provided inside the lining of a rotary container of the dual barrel structure for restraining deformation of the lining due to thermal expansion or the like.

The barrel finishing machine generally comprises a dual barrel structure having a cylindrical stationary container and a rotary container concentrically provided in the stationary container with a small gap therebetween. Inner walls of the stationary and rotary containers are covered by linings formed from urethane, rubber or the like.

In the above-described barrel finishing machine, the rotary container is driven so that toroidal flow of an abrasive media and workpieces is caused in the dual barrel structure, thereby finish-processing the workpieces. A mixture of the abrasive media and workpieces will hereinafter be referred to as "mass." The temperature of the mass becomes higher under the influence of frictional heat produced during a finishing operation. The mass temperature is raised to approximately 100° C. in an extreme case. Such temperature rise in the mass causes the lining of the dual barrel structure to thermally expand. As the result of the thermal expansion, the diameter of the lining covering the inner surface of the rotary container is increased. Increase in the diameter of the lining is also caused by the weight of the mass or the centrifugal force due to rotation of the rotary container. The size of the gap between the stationary and rotary containers is reduced with the increase in the lining diameter, and may cause seizure between the rotary container and the lining of the stationary container. The gap between the stationary and rotary containers needs to be small to prevent galling due to the invasion of abrasive media or the like into the gap. Therefore, the gap cannot be enlarged in to accommodate thermal expansion of the lining.

Measures to prevent expansion of the diameter of the lining covering the inner surface of the rotary container are disclosed by Japanese Laid-open (kokai) Utility Model Registration Application Nos. 48-74392 (1973) and 62-29248 (1987), for example. FIGS. 3 and 4 illustrate these measures respectively.

Referring to FIG. 3, a stopper edge 51 is formed integrally with a base 50*a* (steel) so as to project therefrom at a position slightly inside the outer circumferential edge of a rotary container 50 over the entire circumference thereof. The stopper edge 51 is provided to serve as a weir against thermal expansion of a lining 52 in the outer circumferential direction. On the other hand, in FIG. 4, the stopper edge 51' is formed integrally with the rotary container 50' so as to rise from the outer circumferential edge of the container and be directly opposite to the lining 54' covering the inner surface of the stationary container 53'. Each above-described construction can provide an effective restriction of the expansive deformation of the lining.

Although the foregoing problem resulting from thermal expansion of the lining can be solved by each above-described prior art construction, each construction gives rise to a new problem.

Even the linings of the dual barrel structure are gradually abraded during the finishing operation. Accordingly, the head portion of the stopper edge 51, 51' becomes exposed as the lining wears over time. In many cases, the head portion of the stopper edge 51, 51' is not actually exposed. Rather the stopper edge 51, 51' becomes frequently chipped over most of its length. Once the stopper edge 51, 51' is worn, it ceases serving as a weir against the expansive deformation of the lining. When the container is relined, all the components of the rotary container including the base 50*a*, 50*a'* to be replaced with new ones since the stopper edge 51, 51' is integral with the base 50*a*, 50*a'*. Consequently, repair work is time consuming and the costs of repair are relatively high. Furthermore, in the prior art, the service life of the lining 52, 52' is limited to a range S of the depth from the surface to the head portion of the stopper edge 51, as shown in FIG. 3. Thus, the cycle time period between required relinings is short. Additionally, since wear of the stopper edge 51 requires replacement of an overall rotary container, the degree of wear of the stopper edge 51 needs to be strictly monitored, which necessitates a troublesome check.

Furthermore, when only the rotary container is replaced with a new one in relining the rotary barrel, a step is formed between the worn-out portion of the stationary container, and a sliding face of the rotary container and the step forms a dead space during the finishing operation, which exerts a bad influence upon the finishing. Consequently, the stationary container also needs to be replaced with a new one even if it is not worn much.

SUMMARY OF THE INVENTION

Therefore, an object of the present invention is to provide a barrel finishing machine wherein the service period of the linings of the dual barrel structure can be improved and the repair work can be simplified.

To achieve the above-described object, the present invention provides a barrel finishing machine comprising a dual barrel structure including a cylindrical stationary container and a rotary container concentrically mounted in the stationary container for rotation relative thereto and with a small gap being defined therebetween. A pair of linings formed from an elastic material are provided to cover inner surfaces of the stationary and rotary containers respectively. A stopper member is provided in the lining of the rotary container at a position in the vicinity of an outer circumferential edge of the rotary container for restraining an expansive deformation of the lining of the rotary container due to thermal expansion thereof. The stopper member rises circumferentially from a base of the rotary container, and is detachably attached to the base of the rotary container.

In accordance with the above-described barrel finishing machine, the stopper member becomes gradually chipped as the lining of the rotary container becomes worn. Relining needs to be carried out before the base of the rotary container becomes worn. In the relining operation, the lining is removed from the rotary container, and the worn-out stopper member is then detached from the rotary container to be separated from the base of the container. Subsequently, a new stopper member is attached to the rotary container and the relining is performed.

Even when wear of the lining of the rotary container progresses to some extent, the overall rotary container need not be replaced. Only the stopper member must be replaced with a new one. Consequently, the cost of the relining can be reduced and the relining work can be readily carried out.

The service period of the lining of the rotary container can be increased since the rotary container lining is allowed to be used until the base of the rotary container is worn. Consequently, the life of the dual barrel structure is improved.

Other objects of the present invention will become obvious upon obtaining an understanding of the illustrative embodiment to be described. Various advantages not referred to herein will occur to one skilled in the art upon employment of the invention in practice.

DESCRIPTION OF THE PREFERRED EMBODIMENT

An embodiment of the barrel finishing machine in accordance with the present invention will be described with reference to the accompanying drawings.

Figure 2:
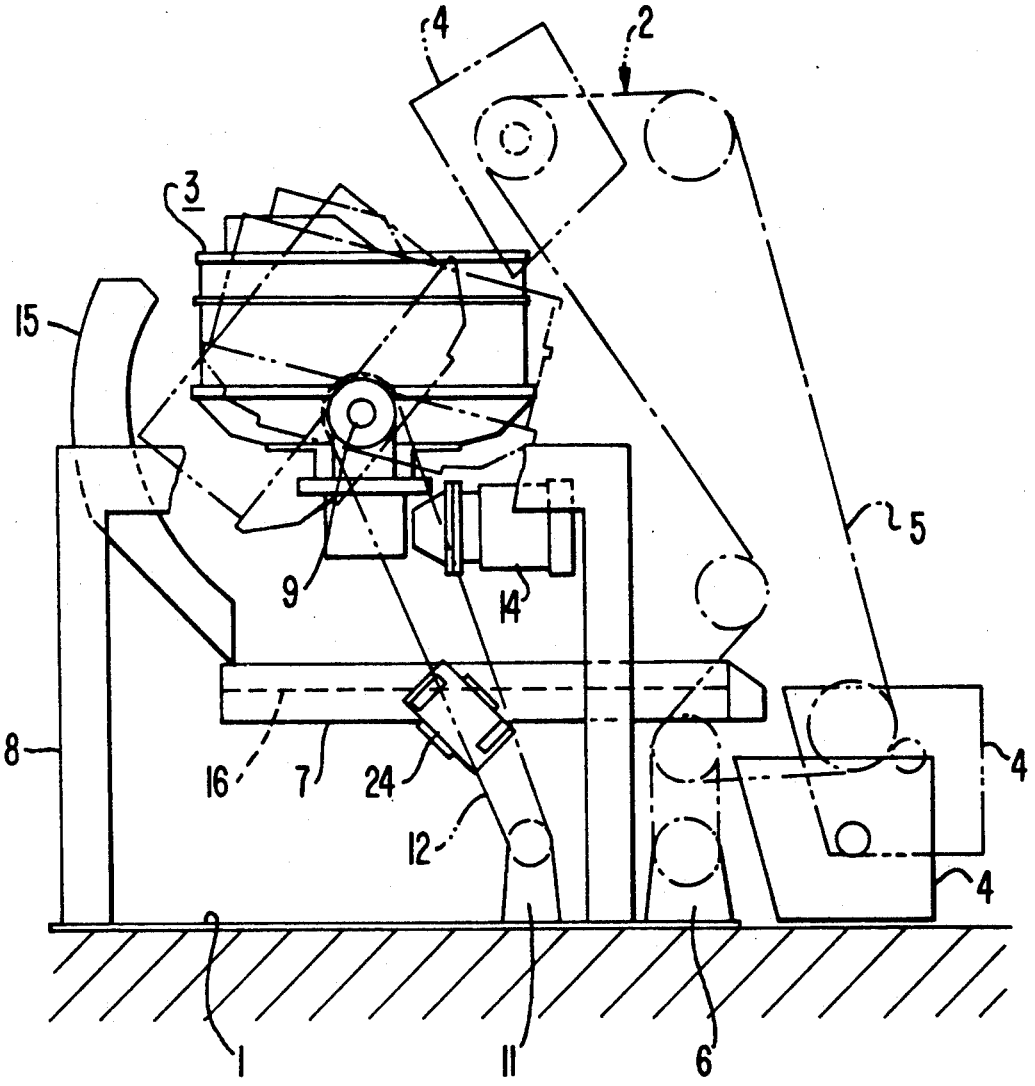
FIG. 2 is a front view of the overall barrel finishing machine.
Figure 3:
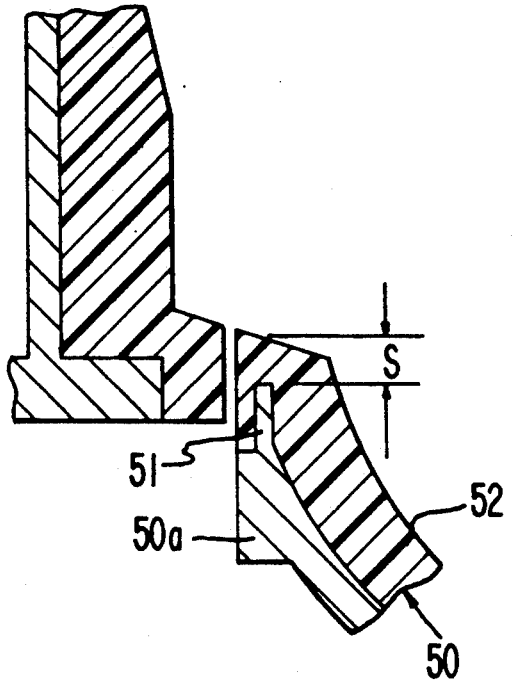
FIG. 3 (PRIOR ART)
FIG. 3 is a view similar to FIG. 1 illustrating a prior art construction of the dual barrel structure.
Figure 4:
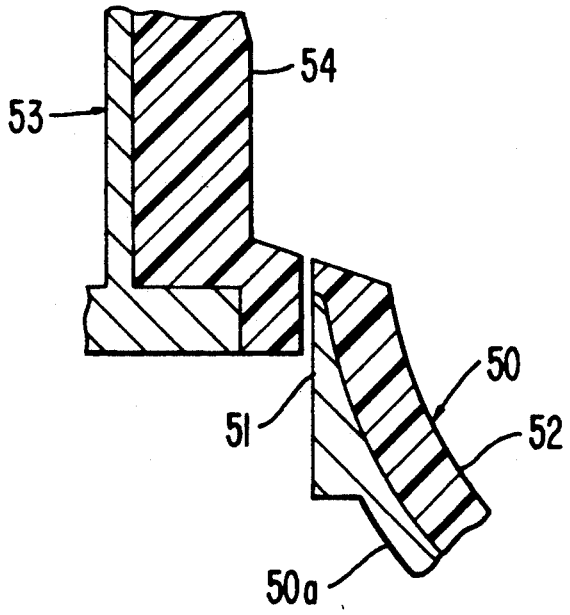
FIG. 4 (PRIOR ART)
FIG. 4 is a view similar to FIG. 1 illustrating another prior art construction of the dual barrel structure.
Figure 5:
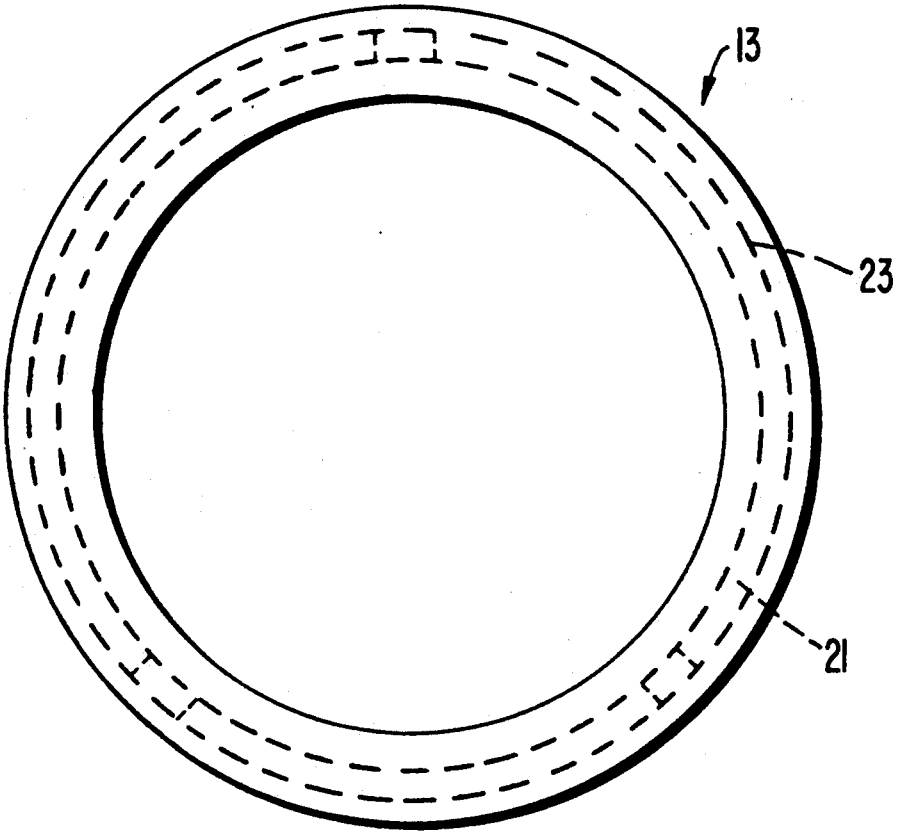
FIG. 5 is a top view of the rotary container showing the plurality of circumferential stopper members.

Referring first to FIG. 2, reference numeral 1 designates a base frame of the barrel finishing machine. A bucket elevator 2 is mounted on the right-hand side of the base frame 1 for feeding a mass of abrasive media and workpieces into a dual barrel structure 3, as viewed in FIG. 2. A bucket 4 of the bucket elevator 2 is moved upward and downward between a stand-by position and a throw-in position by a bucket drive motor 6 via a chain 5 tightly stretched by a plurality of sprocket wheels. The stand-by position of the bucket 4 is beneath a distal end of a screening conveyer 7 which will be described later. At the stand-by position, abrasive media falling from the screening conveyer 7 is received by the bucket 4, and unprocessed workpieces are supplied into the bucket 4 by an operator. The throw-in position of the bucket 4 is set obliquely upward relative to the dual barrel structure 3. When reaching the throw-in position, the bucket 4 is inclined by a predetermined angle such that the mass can be fed into the dual barrel structure 3.

A support frame 8 is mounted at one side of the bucket elevator 2 on the base frame 1. The dual barrel structure 3 is supported by a bearing secured on the support frame 8 so as to be rotatable about a support shaft 9 of the bearing. The support shaft 9 is linked to a barrel reversing motor 11 through a chain 12. A reversible motor is employed as the barrel reversing motor 11 so that the dual barrel structure 3 can be rotated in both directions. More specifically, the dual barrel structure 3 can be rotated in the clockwise direction in FIG. 2 when it is being supplied with the mass from the bucket 4 occupying the throw-in position. The dual barrel structure 3 is rotated approximately by 180 degrees in the counterclockwise direction in FIG. 2 to cause the mass to fall on the screening conveyer 7. A sequential controller is provided in a control panel (not shown) provided on the base for sequence-controlling the reversing motor 11, the bucket drive motor 6, a barrel drive motor 14 and a vibrating motor 24 for the screening conveyer 7 which will be described later.

A guide chute 15 is provided for guiding into the screening conveyer 7 any portion of the mass which is flung out of the dual barrel structure 3 during operation. The guide chute 15 is formed into the shape of a spout with both sides being arc-shaped.

The screening conveyer 7 is disposed nearly beneath the dual barrel structure 3 so that the guide chute 15 is opened over an end of the screening conveyer 7. The screening conveyer 7 has a wire net 16 covering the entire length thereof, for separating the workpieces and the abrasive media. The wire net 16 also serves as a workpiece conveying path, and the bottom of the conveyer 7 under the wire net 16 serves as an abrasive conveying path. A vibrating motor 24 is mounted on one side of the screening conveyer 7 so that the workpieces and the abrasive media are conveyed along the respective paths by way of vibration caused by the vibrating motor 24. A take-out chute (not shown) is connected to the end of the workpiece conveying path. On the other hand, the end of the abrasive media conveying path is located over the stand-by position of the bucket 4 so that the abrasive media can be returned into the bucket 4 for reuse.

The dual barrel structure 3 has a cylindrical stationary container 17 having an upper open end, and a rotary container 13 concentrically mounted in the stationary container 17 so as to be driven by the dual barrel structure drive motor 14.

Figure 1:
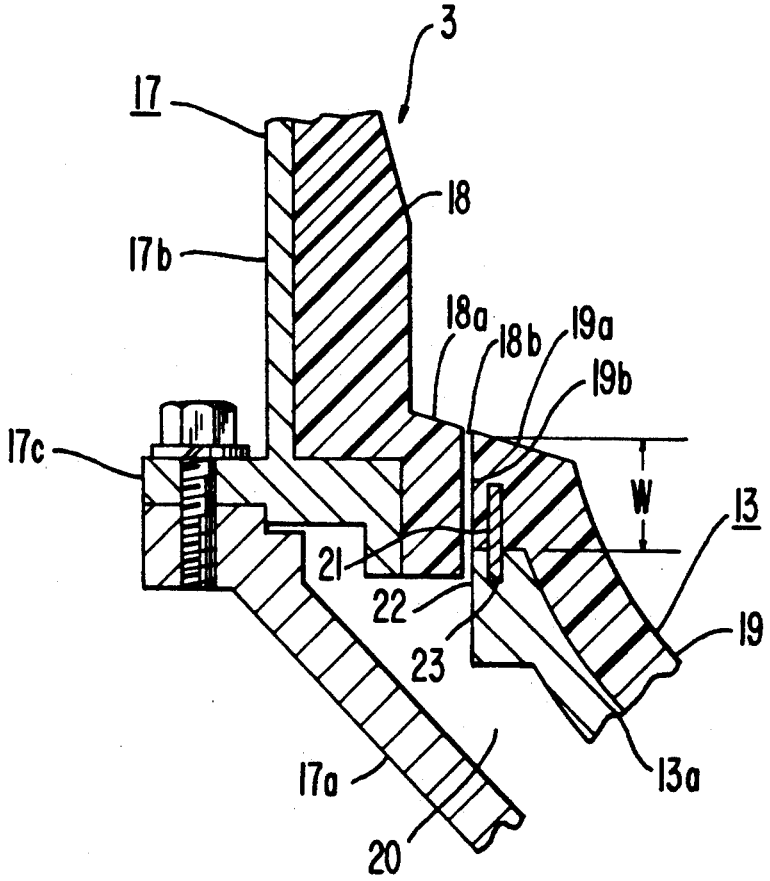
FIG. 1 is a partially enlarged longitudinal section of a dual barrel structure employed in a barrel finishing machine of an embodiment of the present invention.

Referring now to FIG. 1, the stationary container 17 is formed of steel and includes a dish-shaped bottom wall **17*a* and a cylindrical side wall 17*b*. A flange 17*c* integrally formed on the lower end of the side wall 17*b* is placed on the open edge of the bottom wall 17*a* and secured in position by bolts, thereby securing the side wall 17*b* to the bottom wall 17*a*. A lining 18 formed from a urethane resin is provided to cover the inner surface of the side wall 17*b*, with side wall inner surface as a base for the lining 18. A rubber lining may be employed instead of the urethane resin lining. The lining 18 has a downwardly inclined surface 18*a* formed at the lower portion thereof. An opposing face 18*b* is formed by perpendicularly cutting off the lower portion between the inclined surface 18*a* and the lower end of the lining 18**.

The rotary container 13 is disposed under the side wall **17*b* of the stationary container 17 so that the container 13 is concentric with the stationary container 17, and a drainage space 20 is provided between the stationary container bottom wall 17*a* and the rotary container 13. A lining 19 is provided to cover the entire inner surface of a steel base 13*a* of the rotary container 13 in the same manner as in the stationary container 17. The outer circumferential edge of the rotary container 13 has a thickness which is greater than other portions thereof. The lining 19 has an upper inclined surface 19*a* which inclines in a continuous manner with respect to the inclined surface 18*a* of the lining 18 of the stationary container 17. The outer circumferential surface is perpendicularly cut off so as to serve as a rising face opposite to the opposing face 18*b*** with a small gap of about 0.3 to 1 mm therebetween over its entire outer circumference.

A generally ring-shaped attachment edge 22 having a preselected width is formed on the outer circumferential edge of the rotary container 13. An engagement groove 23 into which a stopper member 21 is inserted is formed in the upper face of the attachment edge 22 over its entire circumference. The stopper 21 is formed of a steel plate. In the embodiment, a steel ring defining the stopper member 21 is equally divided into three pieces and each piece is bent into the shape of an arc. Prior to lining the rotary container 13, these pieces are detachably mounted to the engagement groove 23 and placed so that a certain space is provided between each piece and the adjacent one to accommodate thermal expansion of each piece in the circumferential direction. Each piece is embedded in the lining to a predetermined depth as the result of the lining processing. The height of the portion of each piece projecting from the engagement groove 23 is set so as to effectively restrain the expansive deformation of the lining 19. The portion of the lining 19 outside the stopper member 21 serves as a protecting wall portion 19*b*.

The operation of the barrel finishing machine will now be described. Unprocessed workpieces are put into the bucket 4 containing the abrasive media and located at the stand-by position. The bucket drive motor 6 is energized to drive the bucket elevator 2 so that the bucket 4 is raised to the throw-in position. When reaching the throw-in position, the bucket 4 is tilted as shown in FIG. 1. The barrel reversing motor 11 is also energized to tilt the dual barrel structure 3 toward the bucket 4 at that time. The mass in the bucket 4 is thus transferred into the dual barrel structure 3. After the dual barrel structure 3 is returned to the original position, the barrel drive motor 14 is energized to rotate the rotary container 13 so that the workpieces are finish-processed.

A sludge mixture of worn abrasive media, water and the like produced during the finishing operation leaks into the drainage space 20, to be reserved therein, through the gap between the rotary container 13 and the stationary container 17. The sludge mixture is discharged out of the drainage space 20 after completion of the finishing operation. The thermal expansion of the lining 19 of the rotary container 13 is effectively restrained by the stopper member 21.

Upon completion of the finishing, the barrel drive motor 14 is deenergized and then, the barrel reversing motor 11 is energized to rotate the dual barrel structure 3 by about 180 degrees in the counterclockwise direction as in FIG. 2. Consequently, the mass in the dual barrel structure 3 is discharged onto the wire net 16 of the screening conveyer 7. Any portion of the mass that is flung out of the dual barrel structure 3 during operation is caught by the guide chute 15 and is guided therealong onto the screening conveyer 7.

The wire net 16 of the screening conveyer 7 separates the workpieces and the abrasive media. Then, the vibrating motor 24 is energized so that the workpieces and the abrasive media are conveyed by way of vibration. The workpieces are taken out from the take-out chute (not shown) and the abrasive media falls from the end of the conveyer 7 into bucket the 4 occupying the stand-by position for reuse in the finish processing.

When wear of the linings 18, 19 of the stationary and rotary containers 17, 13 respectively progresses with time, the relining is carried out at a suitable time. In this regard, even when the wear of the lining 19 of the rotary container progresses to such a degree that the stopper member 21 is exposed, the lining 19 can be removed from the rotary container 13 by burning the same or by other methods. Then, each piece of the stopper member 21 can be detached from the engagement groove 23 and cut off from the base 13*a* of the rotary container 13. Then, when a new stopper member 21 is attached and the lining is carried out, the rotary container 13 can be readily restored. Consequently, even when the lining is worn to such a degree that the stopper member 21 is exposed, only the stopper member need be replaced with a new one without replacement of the overall rotary container 13, which simplifies the relining work and reduces the cost of the lining.

Since the stopper member 21 is divided into three pieces, attachment and detachment of the stopper member 21 can be performed with ease, which is advantageous particularly in the case of large-sized barrels.

Relining is necessitated in the prior art construction when the stopper member is exposed. Accordingly, the range of wear of the lining is narrow. Therefore, the progress of wear needs to be frequently checked. However, in the present invention, the allowable range of wear of the lining 19 is from the surface of the lining 19 to the upper face of the attachment edge 22, the range including the stopper member 21. The allowable range is shown as dimension W in FIG. 1. Since the allowable range of wear of the lining is thus rendered wider than in the prior art, the service period of the lining is lengthened. Consequently, frequent checking of the wear is not required.

The stopper member may be formed of a material different from that of the base of the rotary container. Further, the material of the stopper member may be other than metal so long as it provides an effective restraint against the expansive deformation of the lining.

The stopper member does have to be divided into three pieces in the case of small-sized barrels. By way of example, an integral ring stopper member may be employed.

The foregoing disclosure and drawings are merely illustrative of the principles of the present invention and are not to be interpreted in a limiting sense. The only limitation is to be determined from the scope of the appended claims.

We claim:

1. A barrel finishing machine comprising:

a) a dual barrel structure including a cylindrical stationary container and a rotary container concentrically mounted in the stationary container for rotation relative thereof, a small gap being defined between the stationary and rotary containers;

b) a pair of linings formed from an elastic material and provided to cover inner surfaces of the stationary and rotary containers, respectively; and c) a stopper member provided in the lining of the rotary container at position in the vicinity of an outer circumferential edge of the rotary container for restraining expansive deformation of the lining of the rotary container due to thermal expansion thereof, the stopper member extending upwardly from a base of the rotary container and extending circumferentially around the base of the rotary container, the stopper member being detachable attached to the base of the rotary container.

2. A barrel finishing machine according to claim 1, wherein the base of the rotary container has a ring-shaped attachment edge formed at the outer circumference thereof, the attachment edge of the rotary container base has an engagement groove formed around the entire circumference thereof, and the stopper member is inserted into the engagement groove.

3. A barrel finishing machine according to claim 2, wherein the stopper member is divided into a plurality of pieces inserted into the engagement groove.

4. A barrel finishing machine according to claim 1, wherein the lining of the rotary container includes an integral protecting wall portion formed outside an outer circumference of the stopper member.

5. A barrel finishing machine according to claim 2, wherein the lining of the rotary container includes a protecting wall portion which is thicker than a remainder of said liner of said rotary container and which is formed outside an outer circumference of the stopper member.

6. A barrel finishing machine according to claim 3, wherein the lining of the rotary container includes a protecting wall portion which is thicker than a remainder of said liner of said rotary container and which is formed outside an outer circumference of the stopper member.

7. A barrel finishing machine according to claim 3, wherein the stopper member is formed from steel.

8. A barrel finishing machine according to claim 1, wherein the stopper member is formed of a material different from a material of the base of the rotary container.

* * * * *